US005186671A

United States Patent [19]

Nagasawa et al.

[11] Patent Number: 5,186,671

[45] Date of Patent: Feb. 16, 1993

[54] MANUFACTURING METHOD OF DISCHARGE LAMP ELECTRODE

[75] Inventors: Masakazu Nagasawa; Masami Handa; Kunio Fukai; Yasuo Hirozumi, all of Shizuoka, Japan

[73] Assignee: Koito Manufacturing Co., Ltd., Tokyo, Japan

[21] Appl. No.: 713,225

[22] Filed: Jun. 11, 1991

[30] Foreign Application Priority Data

Jun. 15, 1990 [JP] Japan ..... 2-155069

[51] Int. Cl.[5] ..... H01J 9/12

[52] U.S. Cl. ..... 445/49; 219/121.66; 219/121.76

[58] Field of Search ..... 445/26, 49; 219/121.66, 219/121.76

[56] References Cited

U.S. PATENT DOCUMENTS

| | | | |
|---|---|---|---|
| 3,378,446 | 4/1968 | Whittlesey | 219/121.76 |
| 3,711,908 | 1/1973 | Broers | 219/121.66 |
| 4,560,357 | 12/1985 | Bouchard et al. | 445/43 |
| 4,678,268 | 7/1987 | Russo et al. | 219/121.66 |

FOREIGN PATENT DOCUMENTS

| | | | |
|---|---|---|---|
| 60-100354 | 6/1985 | Japan | 445/49 |

*Primary Examiner*—Richard K. Seidel
*Assistant Examiner*—Jeffrey T. Knapp
*Attorney, Agent, or Firm*—Sughrue, Mion, Zinn, Macpeak & Seas

[57] ABSTRACT

A discharge lamp electrode having a spherical end portion which serves as a discharge part and has a diameter larger than the remaining base part is formed by simultaneously applying a plurality of laser beams to one end portion of a rod-shaped material of tungsten or tungsten alloy in different directions. Preferably, the rod-shaped material is held vertically while the laser beams are applied to its lower end portion.

4 Claims, 3 Drawing Sheets

MANUFACTURING METHOD OF DISCHARGE LAMP ELECTRODE

BACKGROUND OF THE INVENTION

This invention relates a manufacturing method of an electrode for a discharge lamp (hereinafter referred to as "discharge lamp electrode", when applicable).

In general, a discharge lamp employs tungsten discharge electrodes. Such a tungsten electrode is usually in the form of a rod having a predetermined length. Formerly, the end face of a rod-shaped electrode, which is a discharge part and is held opposite the end face of the other electrode in the discharge space, was an as-cut face of an electrode forming material. In this case, burrs are likely to remain on the cut face, i.e., on the discharge part of the electrode, thus giving rise to the following problem. The initial arc spot is concentrated on the burr, and may move along the burr due to, for instance, vibrations of a vehicle in which the discharge lamp is installed, thus making the discharge operation unstable. In order to overcome this problem, various methods have been proposed in the art to work the end portion of the electrode into a spherical shape.

In one of such methods (hereinafter referred to as "first prior art method", when applicable) as shown in FIG. 5, the end portion of a rod-shaped electrode material 2 is worked to have a spherical surface using a laser beam 3.

In another method (hereinafter referred to as "second prior art method", when applicable) as shown in FIG. 6, discharges are induced between two rod-shaped electrode materials 6 and 6' the end portions of which confront each other, to form the end portions into spherical end portions 6*a*and 6*a'*.

However, the first prior art method involves the following problems, because in order to make spherical the end portion of the rod-shaped material 2 it is essential to apply the laser beam 3 to the material 2 while rotating the material 2. This necessitates a rotating mechanism 4 and adjustments of the rotational speed of the rod-shaped material 2 and the intensity of the laser beam 3. That is, the apparatus for practicing this method becomes intricate in construction, and is not suitable for mass-production of discharge lamp electrodes.

In the second prior art method, it is necessary to provide a container 8 for forming a discharge space, and it is considerably troublesome to attach or detach the rod-shaped materials 6 and 6' placed in the container 8. In particular, electrodes for a small metal halide lamp have small dimensions in diameter and in length (about 5 mm in length). Thus, the second prior art method is not suitable for mass-production of discharge lamp electrodes either.

SUMMARY OF THE INVENTION

This invention has been made to solve the above-described problems of the prior art. An object of the invention is, therefore, to provide a manufacturing method of a discharge lamp electrode that can produce stable discharges and has excellent durability, which method is suitable for large-scale production of discharge lamp electrodes.

In a manufacturing method of a discharge lamp electrode according to the invention, a discharge lamp electrode having a spherical end portion which serves as a discharge part and is larger in diameter than a remaining base part is manufactured by simultaneously applying a plurality of laser beams in different directions to an end portion of a rod-shaped electrode material made of tungsten or tungsten alloy which is fixedly held. Preferably, the rod-shaped electrode material is held vertically while being irradiated with the laser beams. Also, it is preferable that the plurality of laser beams all lie in one plane and are separated from one another by equal angular intervals.

Upon application of the laser beams, the end portion of the rod-shaped material instantaneously falls into a high-temperature, molten state, and it is formed into a spherical shape by virtue of surface tension. Since the laser beams are applied to the end portion of the rod-shaped material in the different directions, the laser beam energy is dispersed in the end portion, whereby thickness of the non-crystalline layer formed in the surface of the spherical end portion becomes uniform, and the end portion has high circularity. In the case where the rod-shaped material is held vertically while being irradiated with the laser beams, the point of action of the molten end portion's own weight (gravity center) coincides with the axis of the base part of the rod-shaped material, providing the spherical end portion being coaxial with the base part.

BRIEF DESCRIPTION OF THE DRAWINGS

FIG. 2(*b*) is a front view of a discharge lamp electrode manufactured by the method of FIG. 2(*a*);

DESCRIPTION OF THE PREFERRED EMBODIMENT

An embodiment of this invention will be described hereinafter with reference to the accompanying drawings.

A discharge lamp unit using electrodes according to the invention, which is a metal halide lamp employed as an automobile headlamp, will be first described with reference to FIG. 1, and then a method of forming the end portion of a discharge electrode into a spherical shape will be described with reference to FIGS. 2(*a*) and 2(*b*).

Figure 1:
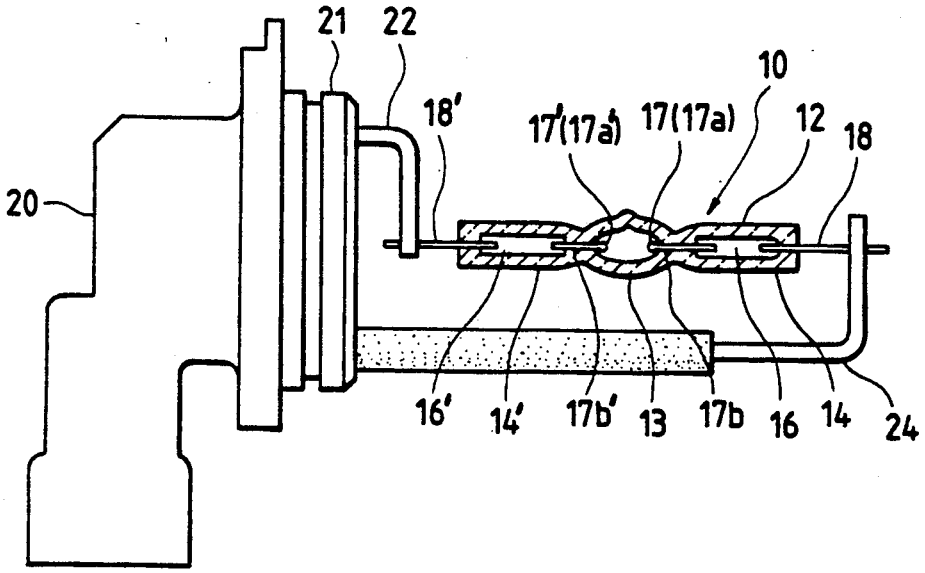
FIG. 1 is a vertical sectional view showing a metal halide lamp used as an automobile headlamp, which employs discharge lamp electrodes made according to this invention.

In FIG. 1, a discharge lamp 10 includes a glass tube 12 made of quartz glass and pinched at both ends, and discharge electrodes 17 and 17' confronting each other in the glass tube 12. The glass tube 12 has, at its middle, an elliptical glass ball 13 which is hollow and closed at both ends to provide a discharge space. A pair of pinched portions 14 and 14' are extended in the opposite directions from both ends of the glass ball 13. Starting rare gas, mercury and metal halide are sealed in the glass ball 13. A molybdenum foil 16 welded to a tungsten electrode 17 and a molybdenum lead wire 18 is sealed in each of the pinched portions 14 and 14'. More specifically, the discharge parts 17*a* and 17*a'* of the electrodes 17 and 17 are protruded towards each other in the discharge space in the glass ball 13, and the lead wires 18 and 18' are extended outwardly from the pinched portions 14 and 14', respectively. The outer end portions of the lead wires 18 and 18' are supported by a shorter lead support 22 and a longer lead support 24 which are protruded from an insulating plug 21 of a lamp socket 20.

The discharge parts 17*a* and 17*a'* are worked into a spherical shape larger in diameter than a base parts 17*b* and 17*b'*. Hence, arc spots will not be concentrated on one point, but distributed to the entire surface of the discharge parts 17*a* and 17*a'*, ensuring a stable discharge operation. That is, as shown in FIG. 2(*a*), laser beams l and l' are applied to the end portion of a rod-shaped material W of tungsten at the same time in the opposite directions and perpendicular to the rod-shaped material W. As a result, the end portion of the rod-shaped material W is formed into the spherical discharge part 17*a* which is larger in diameter than the main part 17*b* (i.e., base part) of the material W.

Figure 2A:
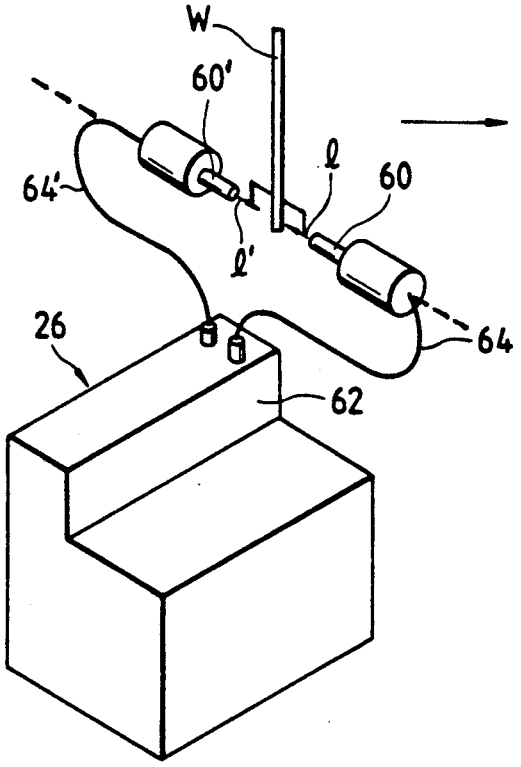
FIG. 2(*a*) is a perspective view for explaining how an end portion of a rod-shaped electrode material is worked into a spherical shape, according to the invention.
Figure 2B:
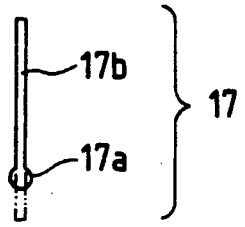

In FIG. 2(*a*), reference numerals 60 and 60' designate laser beam applying sections of an YAG laser unit 26. When irradiated with the laser beams l and l', the end portion of the rod-shaped material W is instantaneously rendered into a high-temperature, molten state by the energy of the laser beams l and l', and the molten end portion is then solidified into a spherical shape by virtue of surface tension acting on the surface of the molten portion, thus forming the discharge part 17*a*. A non-crystalline layer, which is excellent in heat resistance and in heat-resistance-cycling performance, is formed in the surface of the discharge part 17*a*.

Since the laser beams l and l' are applied to the lower end portion of the rod-shaped material W simultaneously from both sides, the laser beam energy is readily dispersed in the rod-shaped material W. As a result, the spherical end portion can be formed in a short period. For the same reason, the entire spherical end portion is uniformly melted and solidified, which contributes to its high circularity and uniform development of the non-crystalline layer over the entire surface of the spherical end portion. Further, in the case where the laser beams l and l' are applied to the lower end portion of the rod-shaped material W which is held vertical, the line of action of the gravity center of the molten end portion coincides with the axis of the base part 17*b* of the rod-shaped material W, and therefore the discharge part 17*a* formed becomes coaxial with the base part 17*b*.

Figure 3:
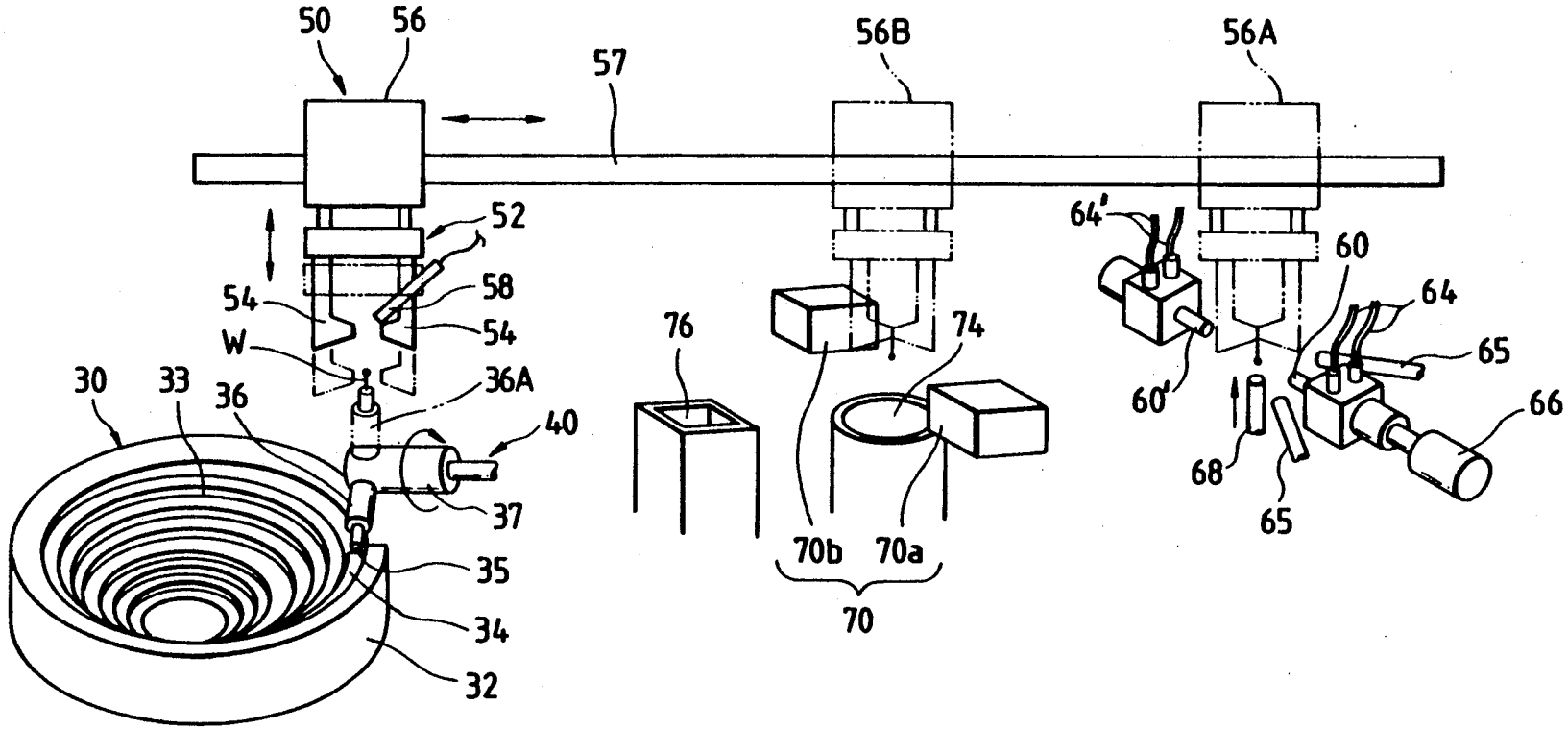
FIG. 3 is a schematic diagram outlining the entire arrangement of an apparatus used for manufacturing discharge lamp electrodes.

FIG. 3 outlines the entire arrangement of an apparatus for manufacturing the electrode. A workpiece feeder 30 includes a workpiece container 32 in the inside of which a spiral workpiece conveying path 33 is formed. Rod-shaped materials W (hereinafter referred to as "workpiece", when applicable) placed in the workpiece container 32 are conveyed, while being subjected to vibrations, along the conveying path 33 toward an outlet 34.

Reference numeral 40 designates a workpiece erecting mechanism for erecting one by one workpieces which are delivered thereto by the workpiece feeder 30. The workpiece erecting mechanism 40 has a rotary shaft 37 and a workpiece inserting section 36 which is extended from the rotary shaft 37 perpendicularly. The workpiece inserting section 36 has a hole 35 in which a workpiece W is kept inserted. At the outlet 34 of the workpiece feeder 30, the workpiece inserting section 36 can be set to become in alignment with the conveying path 33. Under this condition, with negative pressure being applied to the hole 35, the workpiece W is sucked and retained in the hole 35, and the workpiece inserting section 36 is turned to the vertical state indicated by phantom lines 36A; that is, the workpiece W is erected vertically.

Reference numeral 50 denotes a workpiece transfer mechanism 50 which is adapted to hold the workpiece W which has been set upright by the workpiece erecting mechanism 40, and to convey the workpiece W thus held to a predetermined position where it is to be irradiated with laser beams. A vertical slide unit 52 is moved vertically (in the top/bottom direction in FIG. 3) by an air-cylinder mechanism, and has a pair of clamp arms 54 and 54 for holding the workpiece W. A slider 56 supports the slide unit 51 such that the slide unit 51 is vertically slidable, and is mounted on a horizontally extending rail 57 so as to be slidable in the horizontal direction (to the right and left in FIG. 3). An air nozzle 58 is disposed beside one of the clamp arms 54, and is used to separate the workpiece W from the clamp arms 54 to drop it.

A pair of laser beam applying sections 60 and 60' are disposed at a position which is horizontally (to the right in FIG. 3) apart from the workpiece erecting mechanism 40 by a predetermined distance in such a manner that the laser beam applying sections 60 and 60' are positioned on both sides of the workpiece transfer path and face each other. Laser beams are supplied to the laser beam applying sections 60 and 60' through optical fibers 64 and 64' from a laser oscillator 62 (see FIG. 2(*a*)) The laser beams thus supplied are then applied to the lower end portion of the workpiece W which is held vertically with the clamp arms 54. An argon gas is supplied from an argon gas supplying pipe 65 to the laser irradiation point of the workpiece W, thereby preventing the workpiece W from oxidation during the laser beam machining. A CCD camera 66 is set so as to be coaxial with the axis of irradiation of one of the laser beam applying sections 60. The CCD camera 66 photographs the end portion of the workpiece W which is being machined with the laser beams, and the resultant image is displayed on a display unit (not shown). A slide pin 68 is provided under the location where the workpiece W is to be set, in such a manner that the pin 68 is slidable vertically. The slide pin 68 is used, before irradiation of the workpiece W with the laser beams, to push up the workpiece W, at its lower end, being held by the clamp arms 54 to a predetermined height which is suitable for the laser beam irradiation. That is, the slide pin 68 is used for positioning the laser irradiation point of the workpiece W.

Further, a laser configuration measuring unit 70 is provided between the workpiece feeder 30 and the laser beam applying sections 60 and 60' such that it is laid across the workpiece transfer path. The laser configuration measuring unit 70 includes a light emitting section 70*a* which is equipped with a semiconductor laser and a light receiving section 70*b* which faces the emitting section 70*a*. The light emitting section 70*a* applies a parallel laser beam to the workpiece W while scanning it. The laser beam is then received by light-receiving elements in the light receiving section 70*b*, so that the variations in light intensity are converted into an electrical signal, whereby the outside dimensions of the spherical end portion (discharge part) 17*a* of the laser-worked workpiece W are measured. An electrode receiving inlet 74 is disposed right under the configuration measuring unit 70, to receive an electrode which has been determined to be acceptable by the configuration measuring unit 70. In addition, a rejected electrode receiving inlet 76 is disposed next to the electrode receiving inlet 74, to receive an electrode which has been rejected by the configuration measuring unit 70.

Figure 4:
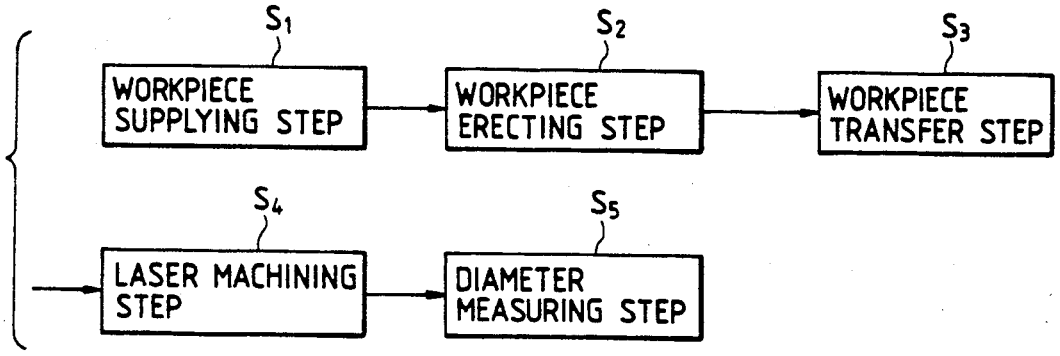
FIG. 4 is a block diagram showing the manufacturing steps of the method according to the invention.
Figure 5:
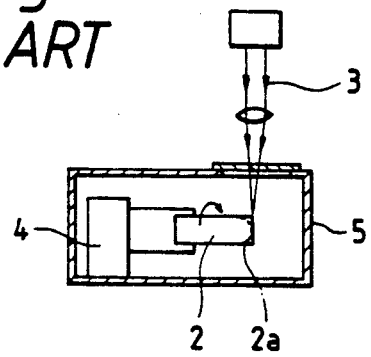
FIG. 5 PRIOR ART
FIG. 5 is a sectional view showing a first prior art method of manufacturing discharge lamp electrodes.
Figure 6:
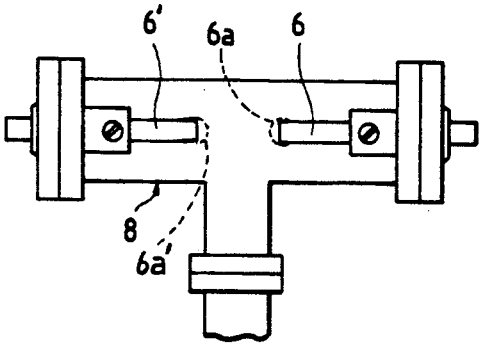
FIG. 6 PRIOR ART
FIG. 6 is a view showing a second prior art method.

A procedure of forming one end portion of the rod-shaped material W into the spherical discharge part 17*a* will be described with reference to FIGS. 3 and 4.

First, a number of workpieces W are put in the workpiece container 32 of the workpiece feeder 30. Then, the workpiece feeder 30 is driven, so that the workpieces W are conveyed along the conveying path 33 (workpiece supplying step $S_1$), and one workpiece W is attracted into the hole 35 of the workpiece inserting section 36 of the workpiece erecting mechanism 40. When the workpiece W has been sucked and retained in this manner, the workpiece erecting mechanism 40 is turned through 90° to set the workpiece W upright (workpiece erecting step $S_2$) Next, in the workpiece transfer mechanism 50, the clamp arms 54 are moved downward to hold the workpiece W being set upright, and then returned to the original position. Under this condition, the slider 56 is slid along the rail 57 until the workpiece W reaches the laser beam applying position, i.e., until the slider 56 reaches the position 56A (workpiece transfer step $S_3$). Then, the workpiece W is positioned in the vertical direction by means of the slide pin 68. Under this condition, the pair of laser beam applying sections 60 of the YAG laser unit 26 (see FIG. 2(*a*)) apply the laser beams to the workpiece W simultaneously, so that the lower end portion of the workpiece W is formed into a spherical shape (laser machining step $S_4$) After this laser machining operation, the slider 56 is moved back to the position of the configuration measuring unit 70 (i.e., the position 56B), where the diameter of the spherical end portion is measured (diameter measuring step $S_5$). When the diameter is determined to be within the predetermined range by the configuration measuring unit 70, then the clamp arms 54 are opened and the workpiece W, i.e., the manufactured electrode is blown by the air from the air nozzle 58 to drop it into the electrode receiving inlet 74. When, on the other hand, the workpiece W is rejected, the slider 56 is further moved until reaching the position of the rejected electrode receiving inlet 76, and the manufactured electrode is dropped into the inlet 76. By the time when the manufactured electrode is dropped into the inlet 74 or 76 in the above-described manner, the workpiece supplying step $S_1$ and the workpiece erecting step $S_2$ have been effected again and another workpiece W has been held vertically by the workpiece erecting mechanism 40. Then, the slider 56 is moved back to the original position, and the workpiece transfer step $S_3$, the laser machining step $S_4$, and the diameter measuring step $S_5$ are carried out in succession. Thus, electrodes are manufactured one after another.

In the above-described embodiment, the electrode 17 was described as being made of tungsten. However, it is noted that it may be made of tungsten alloy, for instance.

In the above-described embodiment, two laser beam applying sections 60 and 60' are provided such that they confront each other. However, the invention is not limited thereto or thereby. More than two, e.g., two or three laser applying sections may be provided such that they are positioned around the workpiece at equal angular intervals.

As was described above, one end portion of the discharge lamp electrode of the invention is formed into the spherical discharge part which is larger in diameter than the base part, so that discharges are induced stably. The end portion of the rod-shaped material is melted with the laser beams instantaneously and then solidified into the spherical form. Therefore, the non-crystalline layer excellent in heat resistance and in heat-resistance-cycling performance is formed in the surface of the spherical end portion thus formed, providing the discharge lamp electrode having high durability.

If, in forming one end portion of the rod-shaped material into a spherical shape, a laser beam (i.e., energy) is applied to only one point of the rod-shaped material, the melting temperature and the solidifying speed in the laser-beam-applying portion may be different than other portions, resulting in a spherical end portion being out of shape. On the other hand, in the electrode manufacturing method of the invention, since a plurality of laser beams are applied to the rod-shaped material simultaneously in different directions, the laser beam energy is absorbed at dispersed points of the workpiece, whereby the non-crystalline layer is formed with uniform thickness over the entire spherical end portion and the entire end portion is melted and solidified uniformly. Thus, the spherical end portion thus formed has high circularity, and the rejection rate is considerably reduced. It is understood that the method of the invention is suitable for manufacture of discharge lamp electrodes on a large scale.

When the laser beams are applied to the rod-shaped material being held vertically, the point of action of the molten end portion's own weight coincides with the axis of the base part. Therefore, in this case, the spherical end portion thus formed becomes coaxial with the base part and, accordingly, the rejection rate is further decreased.

What is claimed is:

1. A method of manufacturing a discharge lamp electrode, comprising the steps of:

preparing a rod-shaped electrode material made of tungsten or tungsten alloy;

fixedly holding the electrode material; and irradiating an end portion of the electrode material with a plurality of laser beams simultaneously in different directions to form the end portion into a spherical shape having a diameter larger than a remaining base portion of the electrode material.

2. The method according to claim 1, wherein the electrode material is held vertically, and the end portion is a lower end portion of the electrode material.

3. The method according to claim 1, wherein the different directions are substantially located in one plane.

4. The method according to claim 3, wherein the different directions form equal angular intervals in the one plane.

* * * * *